US005161766A

United States Patent [19]

Arima

[11] Patent Number: 5,161,766

[45] Date of Patent: Nov. 10, 1992

[54] PORTABLE WORK STATION

[76] Inventor: Ronald H. Arima, 1018 Leith Ave., Santa Clara, Calif. 95054

[21] Appl. No.: 694,899

[22] Filed: May 2, 1991

[51] Int. Cl.[5] ..... A47B 23/00

[52] U.S. Cl. ..... 248/447; 248/444.1; 248/453; 248/458; 248/460

[58] Field of Search ..... 248/460, 445, 454, 447.1, 248/444.1, 457, 441.1, 447, 453, 458

[56] References Cited

U.S. PATENT DOCUMENTS

| | | | |
|---|---|---|---|
| 431,036 | 7/1890 | Dawson | 248/454 |
| 2,671,373 | 3/1954 | Sanzone | 248/161 X |
| 4,465,255 | 8/1984 | Hill | 248/445 X |

FOREIGN PATENT DOCUMENTS

| | | | |
|---|---|---|---|
| 249635 | 7/1966 | Austria | 248/445 |
| 1518012 | 2/1968 | France | 248/445 |

*Primary Examiner*—Alvin C. Chin-Shue
*Attorney, Agent, or Firm*—Jack W. Edwards

[57] ABSTRACT

A portable work station provides support for an article to be used by a person occupying available funiture. The work station has a base adapted to fit beneath the person. Preferably, the base has an axis of rotation and extends laterally therefrom. The base can rotate from an upwardly facing position on one side of the axis to an inverted position on the opposite side. An adjustable arm has a common axis of rotation with the base and extends laterally therefrom to a remote end. The base and the adjustable arm can rotate independently of each other or can be interlocked in a fixed relationship relative to each other so that the base and the arm extend in perpendicular planes. An article supporting portion is connected to the remote end of the adjustable arm. The article supporting portion can be positioned for holding the article and the portable work station can be positioned for either right or left handed applications.

13 Claims, 7 Drawing Sheets

PORTABLE WORK STATION

BACKGROUND OF THE INVENTION

1. Field of the Invention

This invention relates to a portable support for holding an article such as a laptop computer in a desired position for working relative to available furniture. More specifically, it concerns a portable support that can be adjusted for use on either the right or left hand side of a person in a working position and that has multiple adjustments for positioning an article supporting portion in a desired location.

2. Description of the Prior Art

Portable computer users often find it necessary to use available furniture for support while working. Seldom does such furniture provide support for the computers, and in the case of a laptop computer, the operator is expected to hold the computer on his lap while working. Sometimes a lap is not a convenient location for holding a computer while working. Laptop computers can become burdensome if held for long periods of time. Improvised support may not have the stability desired for a computer. Thus, there is a need for a portable support that can accompany a portable computer and provide stable support from all types of available furniture.

Invalids and persons with physical handicaps have special needs for supporting computers, books, writting paper, and meal or snack trays so as to keep everything within easy reach. Such support should be applicable to all types of furniture such as sofas, chairs, wheelchairs, and beds. When not needed, such supports should fold up for easy storage. Known supports for meal trays are usually limited to one applicable type of furniture. Some supports mount only to the arm of a chair or sofa, and without such an available arm, the support can not be used. A support for a snack tray does not have the stability for supporting a heavier object such as a laptop computer that weighs about 8 pounds. Furthermore, a snack tray support does not have the adjustability for positioning as needed for a laptop computer.

SUMMARY OF THE INVENTION

An object of the present invention is to provide a portable work station for holding an article such as a laptop computer in a working position for a person supported by available furniture.

Another object of the invention is to provide support for an article in a working position on either the right or left hand side of a person.

A further object of the invention is to provide a support having multiple adjustments for positioning an article supporting portion in a desired location.

In accordance with the present invention, a portable work station holds an article such as a laptop computer for use by a person who is supported by available furniture. The work station has a base adapted to fit beneath the person. An adjustable arm extends from the base to an end remote therefrom. An article supporting portion is connected to the remote end of the adjustable arm and can be positioned for holding the article.

The base has an axis of rotation and extends laterally therefrom. The base is rotatable about the axis from an upwardly facing position on one side to an inverted position on the opposite side. The base and the adjustable arm can be interlocked in fixed rotational relationship so that the base and the arm extend in perpendicular planes. The portable work station can be positioned for either right or left handed applications by rotation of the base to the opposite side of its axis.

Advantages of the invention include portable support for an article such as a laptop computer, the ability to use with available furniture, adaptability for either right or left handed applications, and multiple adjustments for desired positioning.

These and other objects and advantages of the invention will no doubt become obvious to those of ordinary skill in the art after having read the following detailed description of the preferred embodiment which is illustrated in the various drawing figures.

DESCRIPTION OF THE PREFERRED EMBODIMENT

Figure 1:
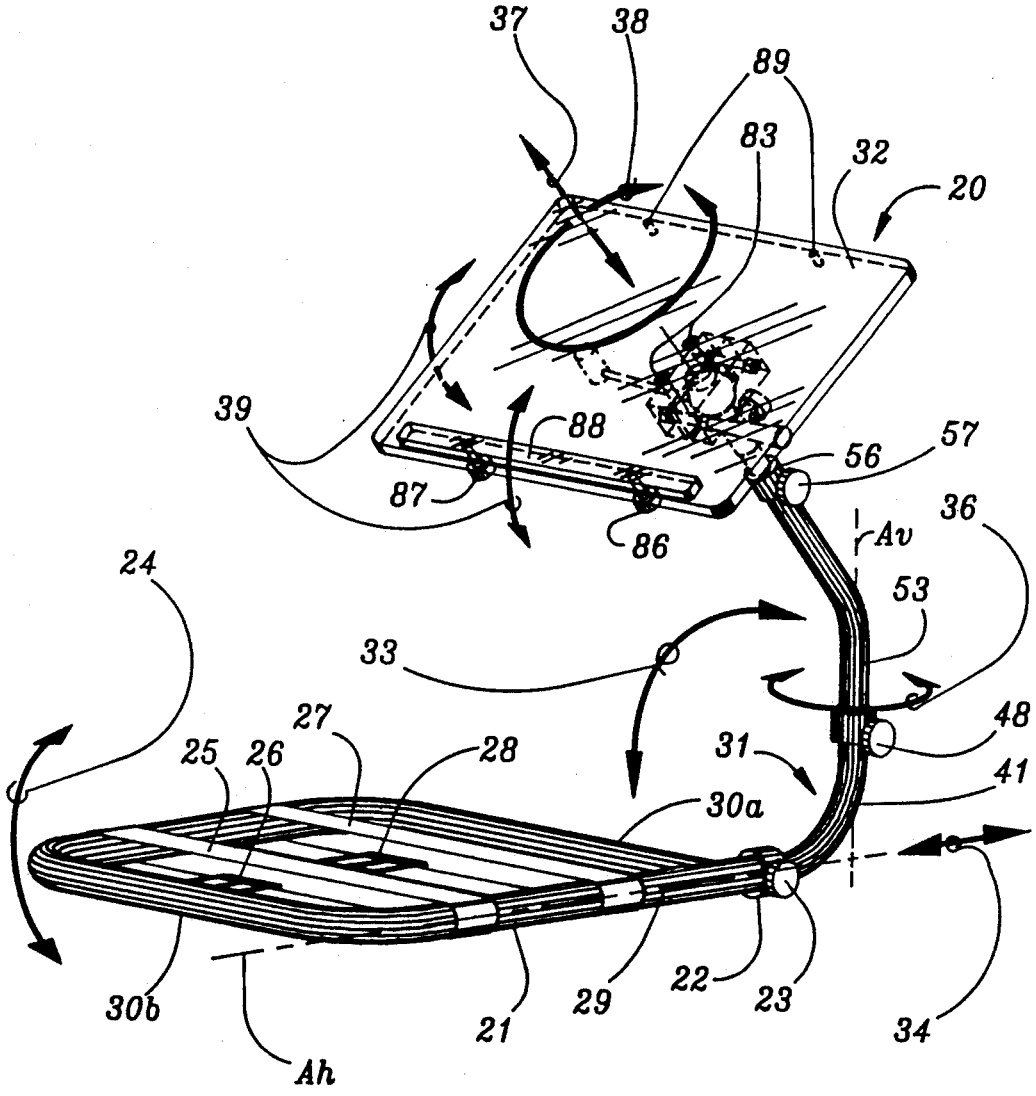
FIG. 1 is a perspective view of a portable work station embodying the present invention taken from an article supporting side.

Looking now at FIG. 1, a portable work station, indicated by general reference numeral 20, has a base 21 formed by tubing bent to form a closed figure of generally rectangular shape with one side 29 extending slightly therebeyond to an end having a collar 22 with a clamping handle 23. The tubing on this side has an axis Ah which extends adjacent and parallel to the side and is also an axis of rotation for the base. The base can rotate thereabout as indicated by arrow 24. Wrapped transversely of the base and the axis of rotation is a webbing strap 25 having a buckle 26 and a webbing strap 27 having a buckle 28.

An adjustable arm, indicated by general reference numeral 31, extends from the base 21 to a remote end having connected thereto an article supporting portion 32. This portion is preferrably made of transparent plastic, but could be made of opaque material. The adjustable arm can rotate about the axis Ah as indicated by an arrow 33 and can move linearly along the axis Ah as indicated by an arrow 34. The adjustable arm has an axis Av that is perpendicular to the axis Ah. An arrow 36 indicates that the adjustable arm portion above the arrow can pivot about the axis Av. Further adjustments of the adjustable arm enable the article supporting portion to move linearly as indicated by an arrow 37, to rotate as indicated by an arrow 38, and to tilt as indicated by arrows 39.

Figure 2:
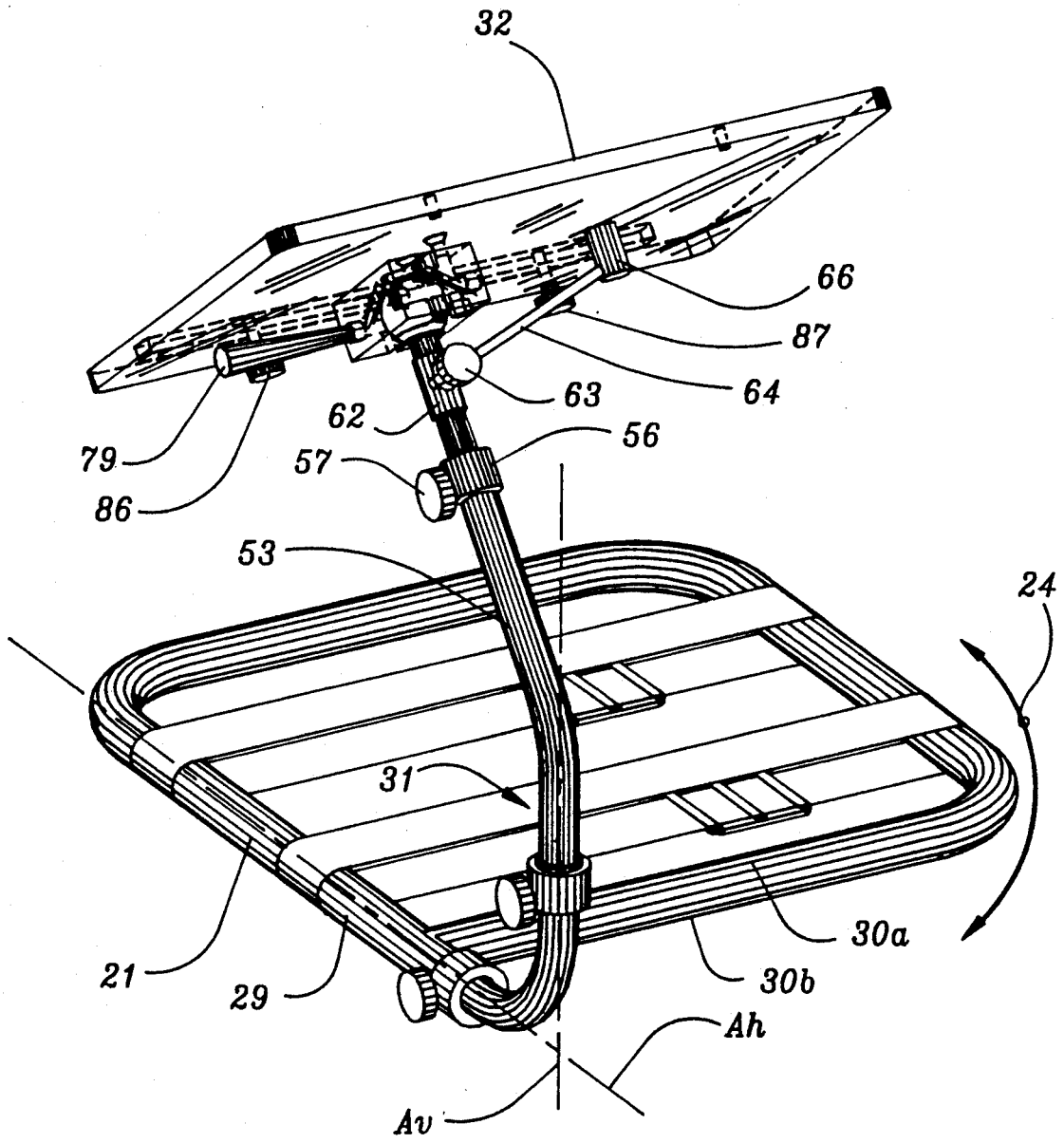
FIG. 2 is a perspective view of the work station shown in FIG. 1 taken from the opposite side.
Figure 3:
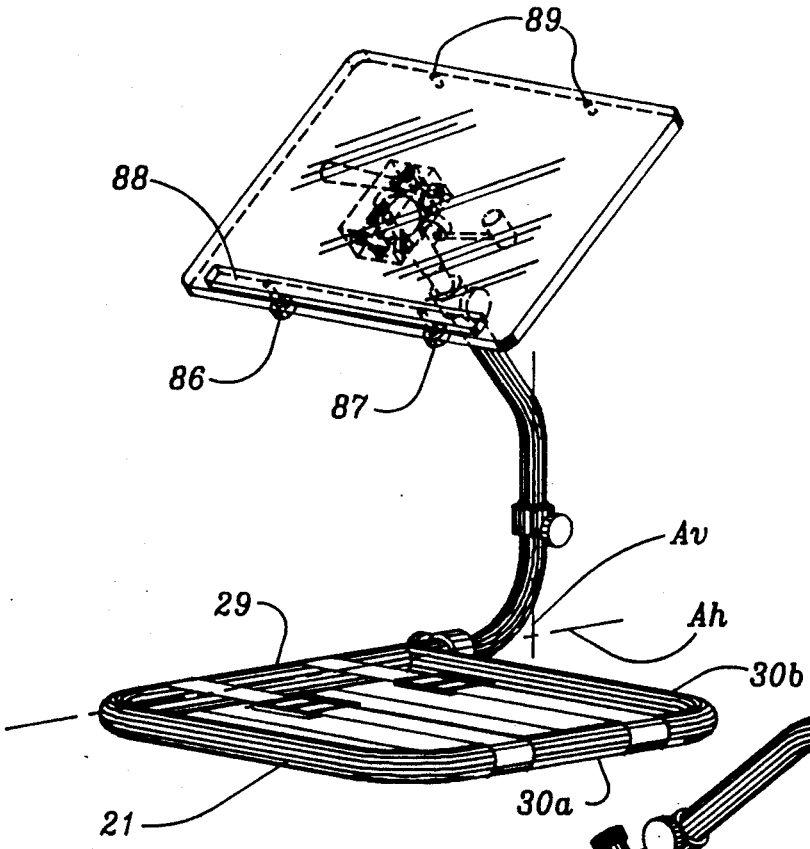
FIG. 3 is a perspective view of the work station shown in FIG. 1 with the base positioned for left handed applications.
Figure 4:
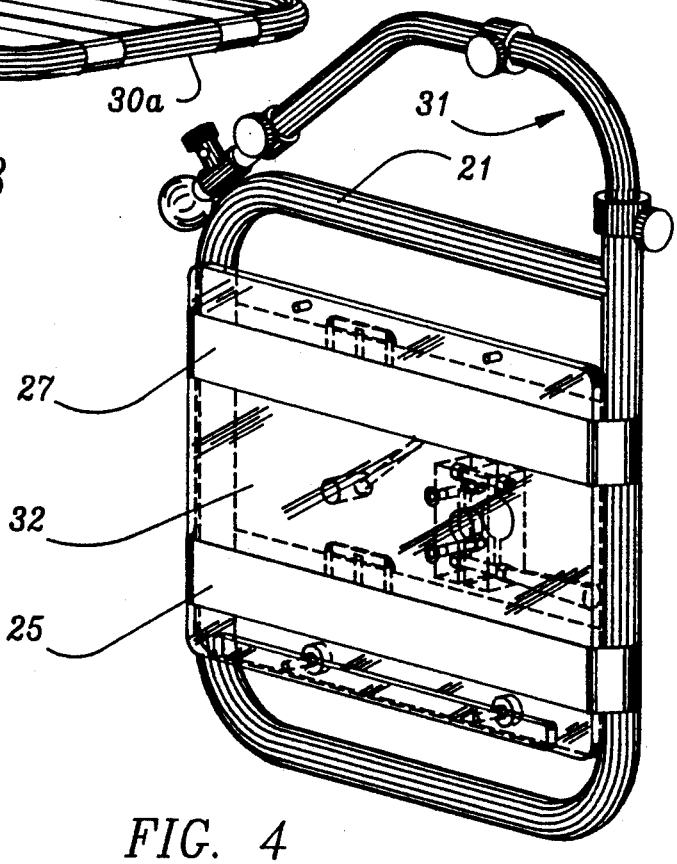
FIG. 4 is a perspective view of the work station shown in FIG. 1 in a folded position for storage or travel.

The adjustable arm 31 from the base 21 to the remote end attached to the article supporting portion 32 is shown more clearly in FIG. 2. In FIGS. 1 and 2, the base has an opposed pair of support engaging faces 30*a* and 30*b* that extend laterally from the side 29 and can be reversed between upwardly and downwardly position by facing rotation of the base about the axis of rotation, as indicated by arrow 24. Thus, the portable work station can be arranged as shown in FIGS. 2 or 3. This enables the portable work station 20 to be positioned for either right or left handed applications. The article supporting portion can be removed and placed over the base, as shown in FIG. 4, with the webbing straps 25 and 27 wrapped thereabout, and the adjustable arm folded to the position shown to form a compact package for storage and transportation.

Figure 5:
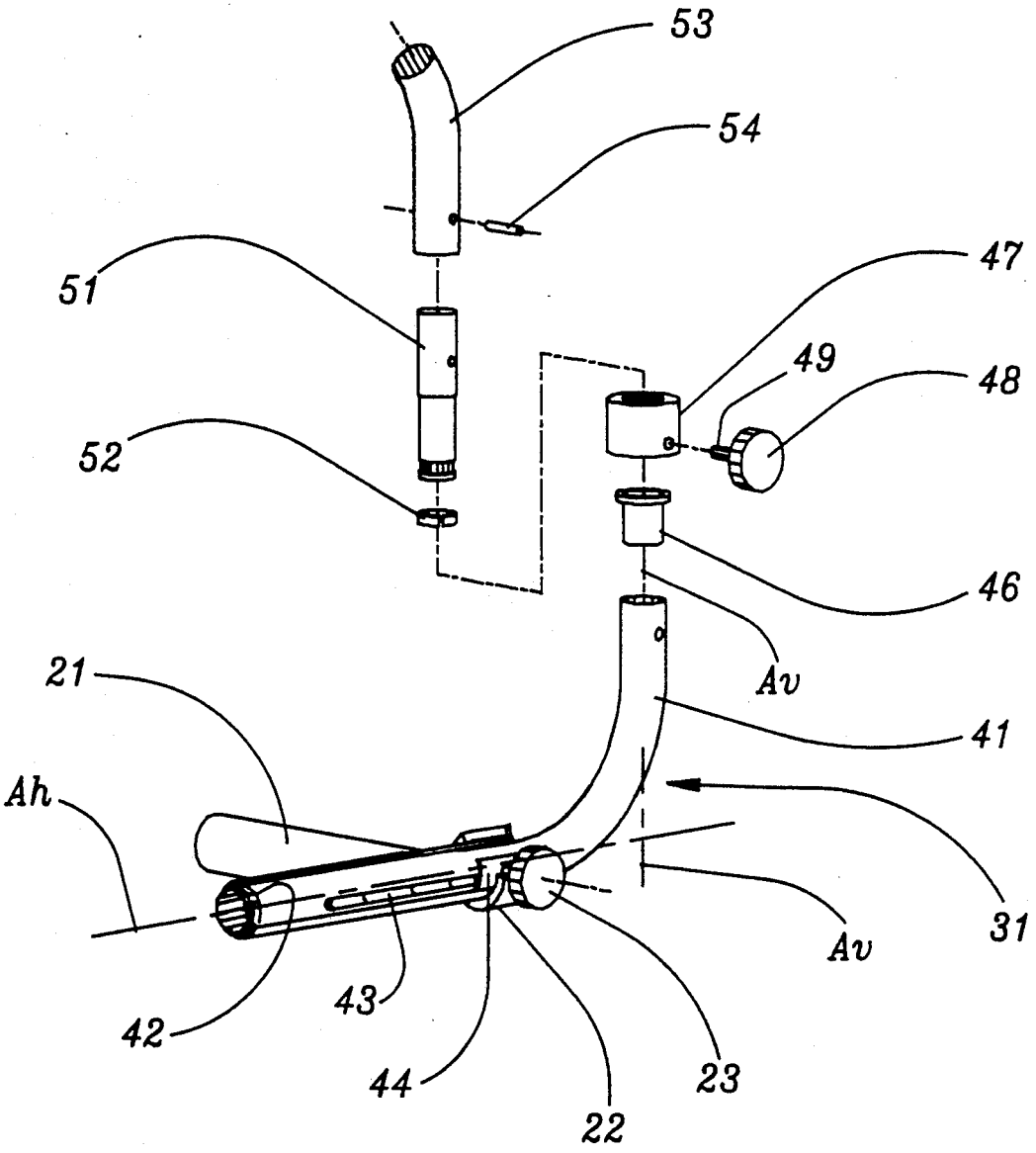
FIG. 5 is an exploded perspective view of an adjustable arm and a base portion with tubing broken away to show underlying structure.

Looking again at FIG. 1, the adjustable arm 31 has a first elbow 41 that fits into the base 21 along the axis Ah. As shown in FIG. 5, a retaining O-ring 42 is provided at the penetrating end of the elbow. An elongated groove 43 extends along one side of the elbow, and a similar groove, not shown, extends along the opposite side of the elbow. A flexible bushing 44 is positioned between the elbow and the base collar 22. By tightening the clamping handle 23, the bushing is forced into the groove to lock the elbow in a fixed position relative to the base 21. By loosening the clamping handle, the elbow can rotate about or move linearly along the axis Ah. The elbow bends from the axis Ah through an angle of 90 degrees to the axis Av. A bushing 46 fits within the elbow and a collar 47 fits about the elbow. A clamping handle 48 has a projecting bolt 49 that fits through openings in the collar and elbow to bear against the bushing 46. Fitting through the bushing is a pivot shaft 51 having a retaining ring 52 at the penetrating end. The pivot shaft can be locked against rotation by tightening the clamping handle 48. A second elbow 53 can be connected to the pivot shaft by a roll pin 54.

Figure 6:
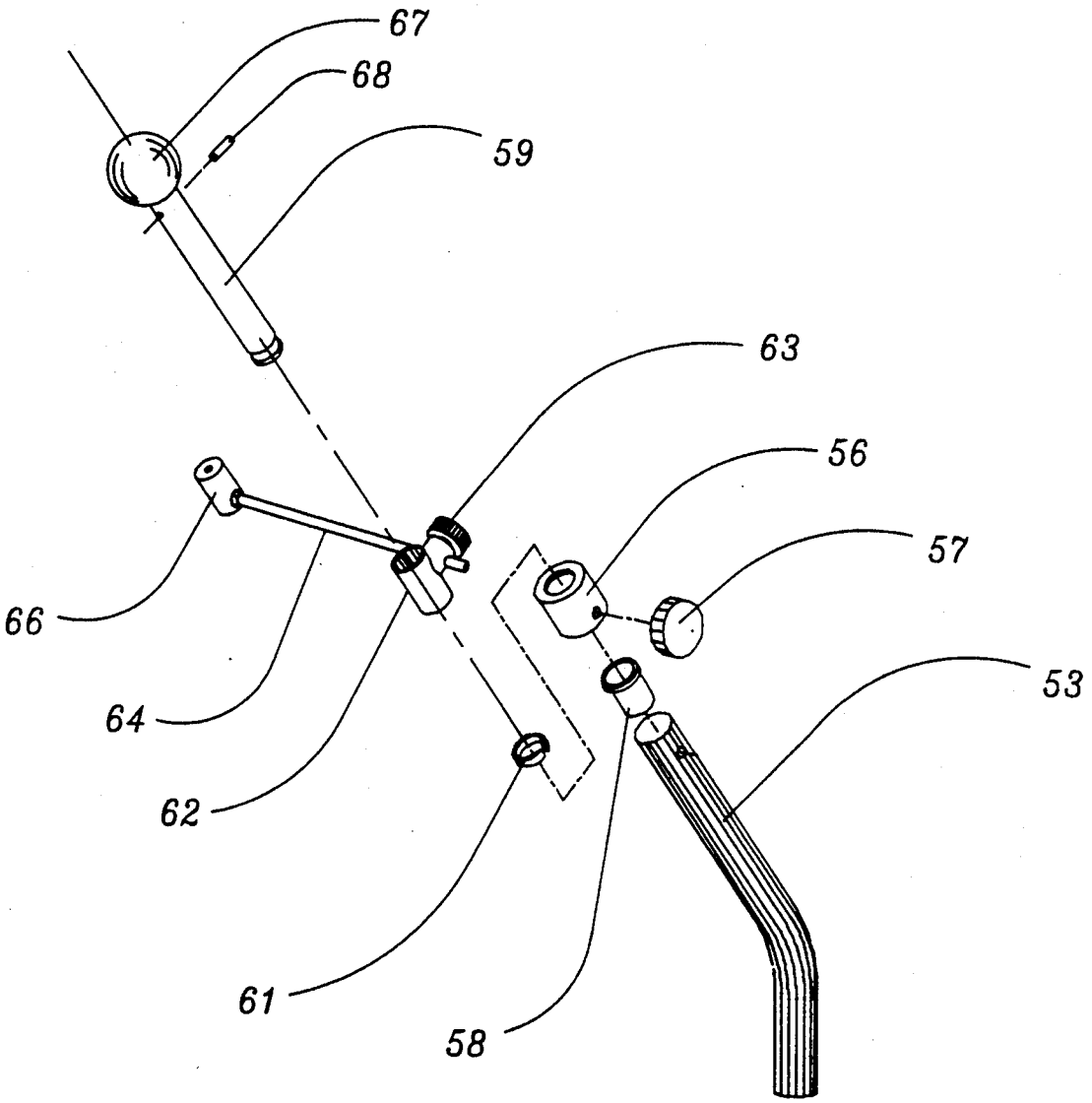
FIG. 6 is an exploded perspective view of a teletubing and stabilizer assembly.

As shown in FIGS. 1 and 2, the second elbow 53 bends at an obtuse angle to the axis Av and has a collar 56 with a clamping handle 57 at the projecting end. With reference to FIG. 6, a bushing 58 fits within the second elbow and is controlled by the clamping handle. A teletubing 59 fits through the bushing and is held therein by a retaining ring 61. An optional stabilizer has a bracket 62 with a sleeve portion through which the teletubing can fit and a clamping handle 63 for controlling movement of a stabilizer bar 64. A supporting stud 66 is universally connected to the stabilizer bar. A ball joint 67 has a stud that is connected to the end of the teletubing by a roll pin 68.

Figure 7:
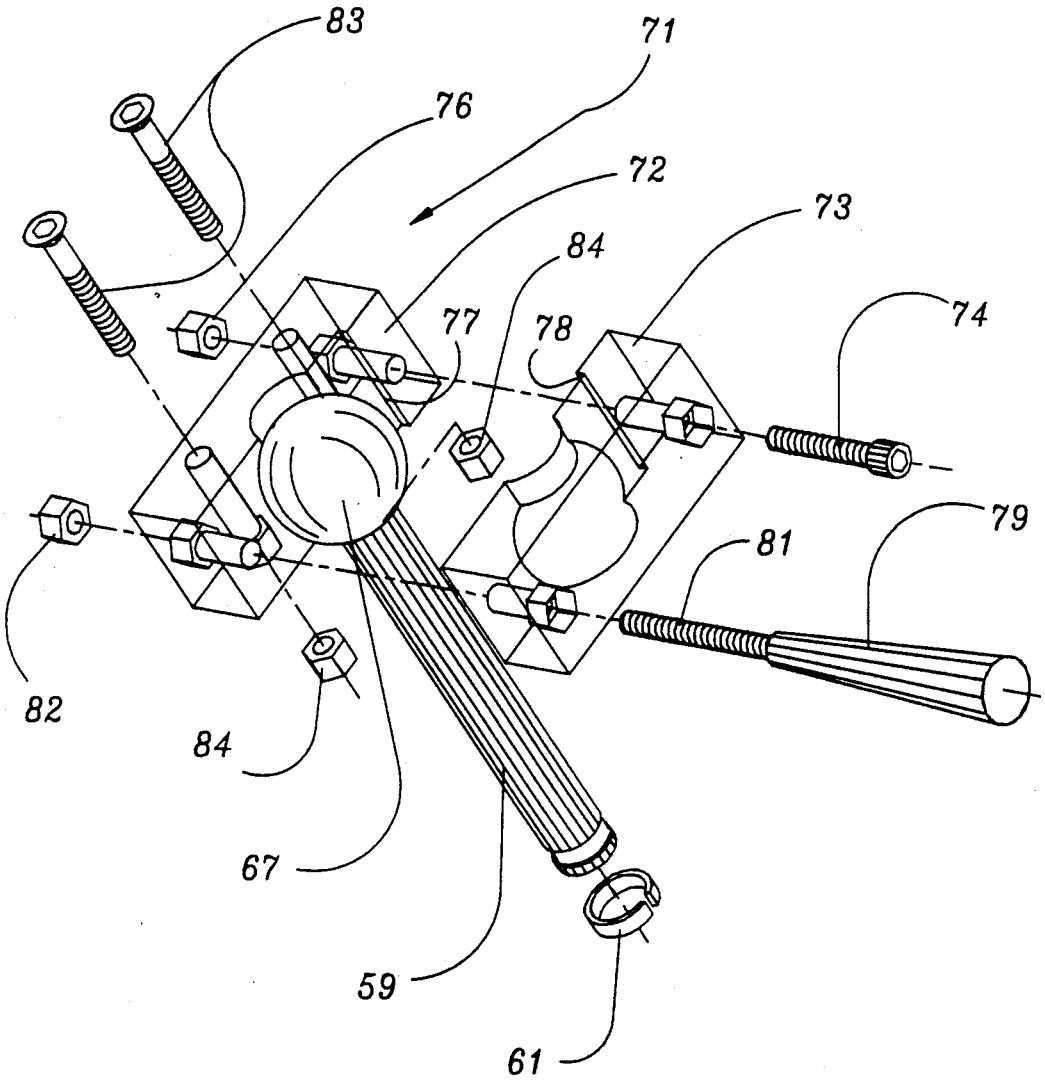
FIG. 7 is an exploded perspective view of a ball joint clamp assembly.

Looking now at FIG. 7, a clamp assembly, indicated by general reference numeral 71 has housing sections 72 and 73 that fit about the ball joint 67. The housing sections are held together at abutting faces by a cap screw 74 fitting through openings in the sections and a hex nut 76. Section 72 is recessed at step 77 and section 73 is recessed at step 78. Both sections have recesses for receiving the ball joint. The sections are tightened about the ball joint by a clamping handle 79 having a projecting screw 81 that fits through openings in the sections and a hex nut 82. A pair of flat head mounting screws 83 fit through openings in the article supporting portion 32(FIG. 1), housing section 72 and hex nuts 84 to fasten the article supporting portion to the remote end of the adjustable arm 31.

Looking again at FIG. 2, the supporting stud 66 is attached to and provides support for the article supporting portion 31 in the event that clamping handle 79 is loosened while a heavy load is supported. Thumb screws 86 and 87 project upwardly through the article supporting portion to fasten thereto a retainer 88, shown in FIGS. 1 and 3. While the retainer is mounted along the lower edge of the article supporting portion, thumb screw openings 89 are also provided along the upper edge. Thus, when the article supporting portion is rotated for opposite handed application, the retainer can be repositioned at the lower edge.

Figure 8:
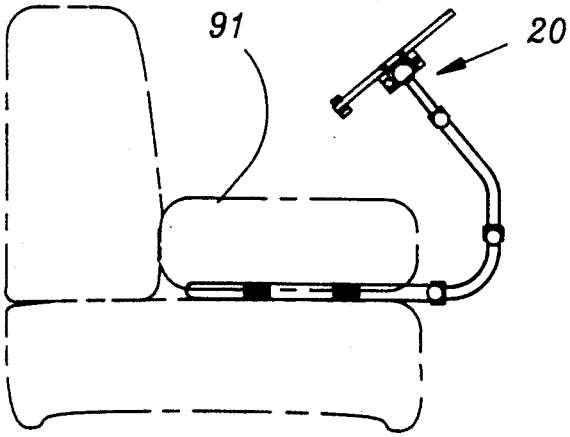
FIG. 8 is a diagrammatic view of a work station applied to a sofa or car seat with a separable cushion.
Figure 9:
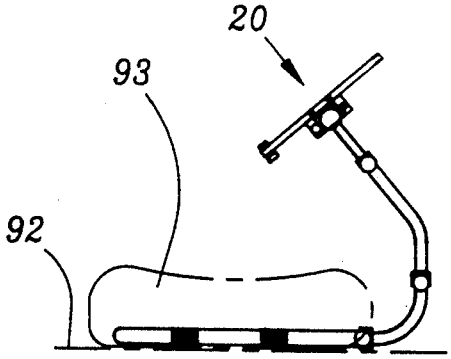
FIG. 9 is a diagrammatic view of a work station supported on a floor beneath a floor cushion.
Figure 10:
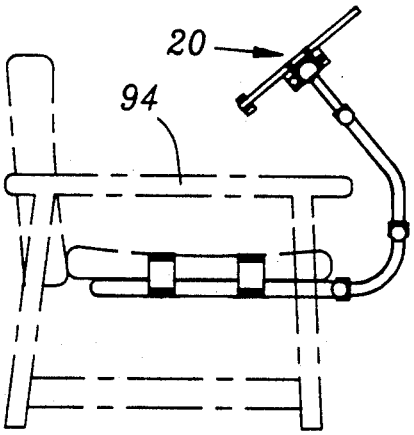
FIG. 10 is a diagrammatic view of a work station strapped to the underside of a chair seat.
Figure 11:
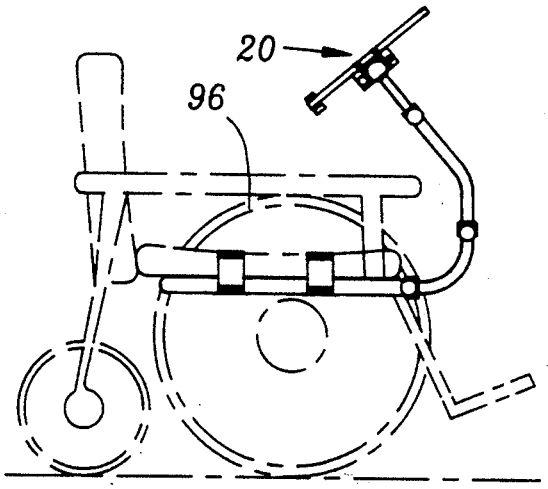
FIG. 11 is a diagrammatic view of a work station strapped to the underside of a wheelchair seat.
Figure 12:
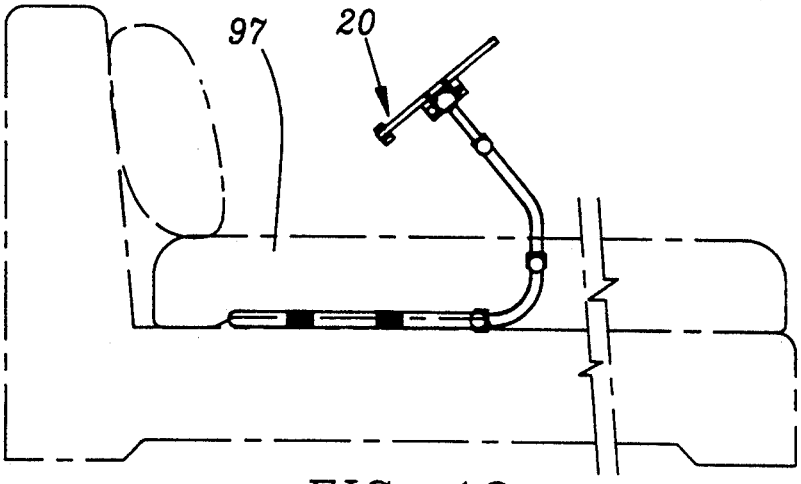
FIG. 12 is a diagrammatic view of a work station applied to a bed.

With reference to FIG. 8, the portable work station 20 can be applied to a chair, sofa or car seat with a separable seat cushion 91. Even the separable cushion could be omitted and the person could sit directly on the base webbing straps 25 and 27. As shown in FIG. 9, the work station can be supported on a floor 92 beneath a cushion 93. The work station can be strapped to the underside of a seat for a chair 94, as shown in FIG. 10, or a wheelchair 96, as shown in FIG. 11. FIG. 12 illustrates the work station applied to a bed with a mattress 97.

From the foregoing description, it will be seen that a portable work station 20 has a base 21 adapted to fit beneath a person. An adjustable arm 31 extends from the base to an end remote therefrom. An article supporting portion 32 is connected to the remote end of the adjustable arm and can be positioned for holding an article. In a preferred embodiment, the base has an axis of rotation Ah and extends laterally therefrom. The base is rotatable about the axis from an upwardly facing position on one side to an inverted position on the opposite side. The base and the adjustable arm can be interlocked in fixed relationship so that the base and the arm extend in perpendicular planes. The portable work station can be positioned for either right or left handed applications by rotation of the base to the opposite side of its axis, rotation of the article supporting portion to project towards the same side as the base, and repositioning the retainer 88 at the lower edge of the article supporting portion.

Although the present invention has been described in terms of the presently preferred embodiment, it is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A portable work station comprising:

a base having a side and an axis of rotation that extends adjacent and parallel to the side, said base having pair of opposed support engaging faces that extend laterally from the side and that can be reversed between upwardly and downwardly facing positions by rotation of the base about the axis of rotation, an adjustable arm having an axis of rotation common with the axis of rotation of the base, said ajustable arm extending from the base and bending from the arm axis of rotation to an end remote therefrom, said base and said adjustable arm being rotatable independently of each other, means for interlocking said base and said adjustable arm in fixed relationship relative to each other so that the base and the arm extend in perpendicular planes, and an article supporting portion connected to the remote end of the adjustable arm, whereby said portable work station can be positioned for either right or left handed applications by rotation of the base to the opposite side of its axis of rotation.

2. The portable work station of claim 1 wherein said article supporting portion is removable from the remote end of the adjustable arm, and said adjustable arm can be rotated to a common plane adjacent the base for compact storage.

3. The portable work station of claim 1 wherein said base and said adjustable arm fit telescopically together about the common axis of rotation and provide for linear adjustment along the axis.

4. The portable work station of claim 1 wherein said adjustable arm includes a first elbow that bends from the common axis of rotation with the base to an axis perpendicular thereto, and a second elbow that is connected to the first elbow along the perpendicular axis and that bends therefrom at an obtuse angle, said second elbow being rotatable about the perpendicular axis.

5. The portable work station of claim 4 wherein said adjustable arm further includes a teletubing portion that fits within the second elbow portion bent at an obtuse angle to the perpendicular axis, said teletubing portion being adjustable linearly within the second elbow.

6. The portable work station of claim 5 wherein said teletubing has a ball joint connected thereto, a first clamp housing adapted to fit about a portion of the ball joint and connected to the article supporting portion, a second clamp housing adapted to fit about a second portion of the ball joint and clamp to the first clamp housing, whereby said article supporting portion can tilt and swivel relative to the ball joint.

7. The portable work station of claim 1 wherein said base and said adjustable arm fit telescopically together about the common axis of rotation and provide for linear adjustment along the axis, said adjustable arm includes a first elbow that bends from the common axis of rotation with the base to an axis perpendicular thereto and a second elbow that is connected to the first elbow along the perpendicular axis, said second elbow having a portion bent at an obtuse angle to the perpendicular axis, said adjustable arm further including a teletubing portion being adjustable linearly within the second elbow portion.

8. The portable work station of claim 1 wherein said base is formed by tubing bent to form a closed figure of generally rectangular shape with one side tubing being coaxial with the base axis of rotation, and further including a plurality of webbing straps that are wrapped transversely of the base and the axis of rotation.

9. The portable work station of claim 8 wherein said base is positioned beneath a cushion for supporting a person using the work station.

10. The portable work station of claim 9 wherein said base is strapped to the bottom of a chair seat by the webbing straps.

11. The portable work station of claim 1 wherein said base is formed by tubing bent to form a closed figure of generally rectangular shape with one side tubing being coaxial with the base axis of rotation, said article supporting portion being removable from the remote end of the adjustable arm and having a size similar to the rectangular base to fit thereon, said adjustable arm being rotatable to a common plane adjacent the base, and further including a plurality of webbing straps that wrap around the base transversely of the axis of rotation and around the article supporting portion to form a compact package for storage or transportation.

12. In a portable work station that holds an article such as a laptop computer within reach of a person who is supported by available furniture, said work station having a base adapted to fit beneath the person, an adjustable arm extending from the base to an end remote therefrom, and an article supporting portion connected to the remote end of the adjustable arm, the improvement comprising:

said base having a side and an axis of rotation that extends adjacent and parallel to the side, said base having an opposed pair of support engaging faces that extend laterally from the side and that can be reversed between upwardly and downwardly facing positions by rotation of the base about the axis of rotation, said adjustable arm having an axis of rotation common with the axis of rotation of the base, said base and said adjustable arm being rotatable independently of each other, and means for interlocking said base and said adjustable arm in fixed relationship relative to each other so that the base and the arm extend in perpendicular planes, whereby said portable work station can be positioned for either right or left handed applications by rotation of the base to the opposite side of its axis of rotation.

13. A portable work station comprising:

an article supporting portion, an adjustable arm having one end connected to the article supporting portion and an opposite end having an axis of rotation, said arm bending from the axis of rotation to the end connected to the article supporting portion, a base having a side and an axis of rotation that extends adjacent and parallel to the side, said base having a pair of opposed support engaging faces that extend laterally from the side and that can be reversed between upwardly and downwardly facing positions by rotation of the base about its axis of rotation, said base and said adjustable arm being connected with the axis of rotation of each forming a common axis and being rotatable independently of each other, and means for interlocking the base and the adjustable arm in fixed relationship relative to each other so that the base and the arm extend in perpendicular planes, whereby said portable work station can be positioned for either right or left handed applications by rotation of the base to the opposite side of its axis of rotation.

* * * * *

UNITED STATES PATENT AND TRADEMARK OFFICE

CERTIFICATE OF CORRECTION

PATENT NO. : 5,161,766

DATED : Nov. 10, 1992

INVENTOR(S) : RONALD H. ARIMA

It is certified that error appears in the above-identified patent and that said Letters Patent is hereby corrected as shown below:

Col. 3, lines 12 and 13, "position by facing" should read --facing positions by--.

Signed and Sealed this

Nineteenth Day of October, 1993

*Attest:*

*Attesting Officer*

BRUCE LEHMAN

*Commissioner of Patents and Trademarks*